US005161987A

United States Patent [19]

Sinisi

[11] Patent Number: 5,161,987

[45] Date of Patent: Nov. 10, 1992

[54] CONNECTOR WITH ONE PIECE GROUND BUS

[75] Inventor: David B. Sinisi, Harrisburg, Pa.

[73] Assignee: AMP Incorporated, Harrisburg, Pa.

[21] Appl. No.: 835,787

[22] Filed: Feb. 14, 1992

[51] Int. Cl.[5] ..... H01R 13/652

[52] U.S. Cl. ..... 439/101; 439/108

[58] Field of Search ..... 439/101, 108

[56] References Cited

U.S. PATENT DOCUMENTS

| | | | |
|---|---|---|---|
| 4,747,787 | 5/1988 | Siwinski | 439/108 |
| 4,762,500 | 8/1988 | Dola et al. | 439/79 |
| 4,824,384 | 4/1989 | Nicholas et al. | 439/108 |

*Primary Examiner*—Gary F. Paumen

*Attorney, Agent, or Firm*—James M. Trygg

[57] ABSTRACT

A micro-strip type connector is disclosed having a one-piece receptacle ground bus. The connector includes two parallel rows of signal contacts, one row on each side of the ground bus, the signal contacts and the bus bar having solder tails that extend through plated through holes in a substrate, such as a printed circuit board, and are soldered in place there. The one-piece receptacle ground bus includes a flat vertically disposed root section, a plurality of first contact beams in a row and extending from the top edge of the root section and a plurality of members extending from the bottom edge which are bent around through 180 degrees to be parallel with the root section and extending upwardly to form another row of second contact beams, the two rows of beams converging. A plurality of solder tails extend from the bottom edge of the root section.

9 Claims, 5 Drawing Sheets

CONNECTOR WITH ONE PIECE GROUND BUS

This invention relates to printed circuit board electrical connectors of the type having a ground bus adjacent a row of signal terminals or between two parallel rows of such terminals

BACKGROUND OF THE INVENTION

Controlled characteristic impedance electrical connectors for interconnecting printed circuit boards frequently employ a ground bus which parallels one or more rows of signal contacts. Where relatively high speed, error free data transmission is required, special care must be taken when designing the components of these connectors to assure proper spacing and to minimize the effects of discontinuities. Such a connector is disclosed in U.S. Pat. No. 4,762,500 which issued Aug. 7, 1988 to Dola et al, and is incorporated by reference as though set forth verbatim herein. A blade-like male ground bus and a mating female receptacle ground bus are disclosed there where the receptacle ground bus is constructed from two mating halves. The two mating halves include flat opposing contact sections for mating electrical contact with the blade type male ground bus, and solder tails which extend into plated through holes in a printed circuit board and are soldered in place. From the electrical standpoint this is an excellent structure in such controlled impedance connectors, however, the two separate pieces of the receptacle ground bus are not easily assembled into the connector housing.

What is needed is a receptacle ground bus of unitary construction that will maintain the controlled characteristic impedance of the connector.

SUMMARY OF THE INVENTION

The present invention includes a controlled impedance electrical connector in which a plurality of signal contacts are arranged in at least one row. A ground bus, extending substantially the length of the row of signal contacts is adjacent thereto and separated therefrom by a dielectric wall. The ground bus has a root section of approximately rectangular cross section and a plurality of spaced beams extending from one side of the root section each of which terminates in a first contact. A plurality of spaced members extend from an opposite side of the root section, each member following an arcuate path for substantially 180 degrees and then extending substantially parallel to the root section thereby forming a shank. Each member continues to extend from the shank to form a second beam which terminates in a second contact. A plurality of leads extend from the opposite side of the root section for making electrical contact with circuits on a substrate.

BRIEF DESCRIPTION OF THE DRAWINGS

FIGS. 6 and 7 are cross-sectional views taken along the lines 6—6 and 7—7 respectively in FIG. 4.

DESCRIPTION OF THE PREFERRED EMBODIMENT

Figure 1:
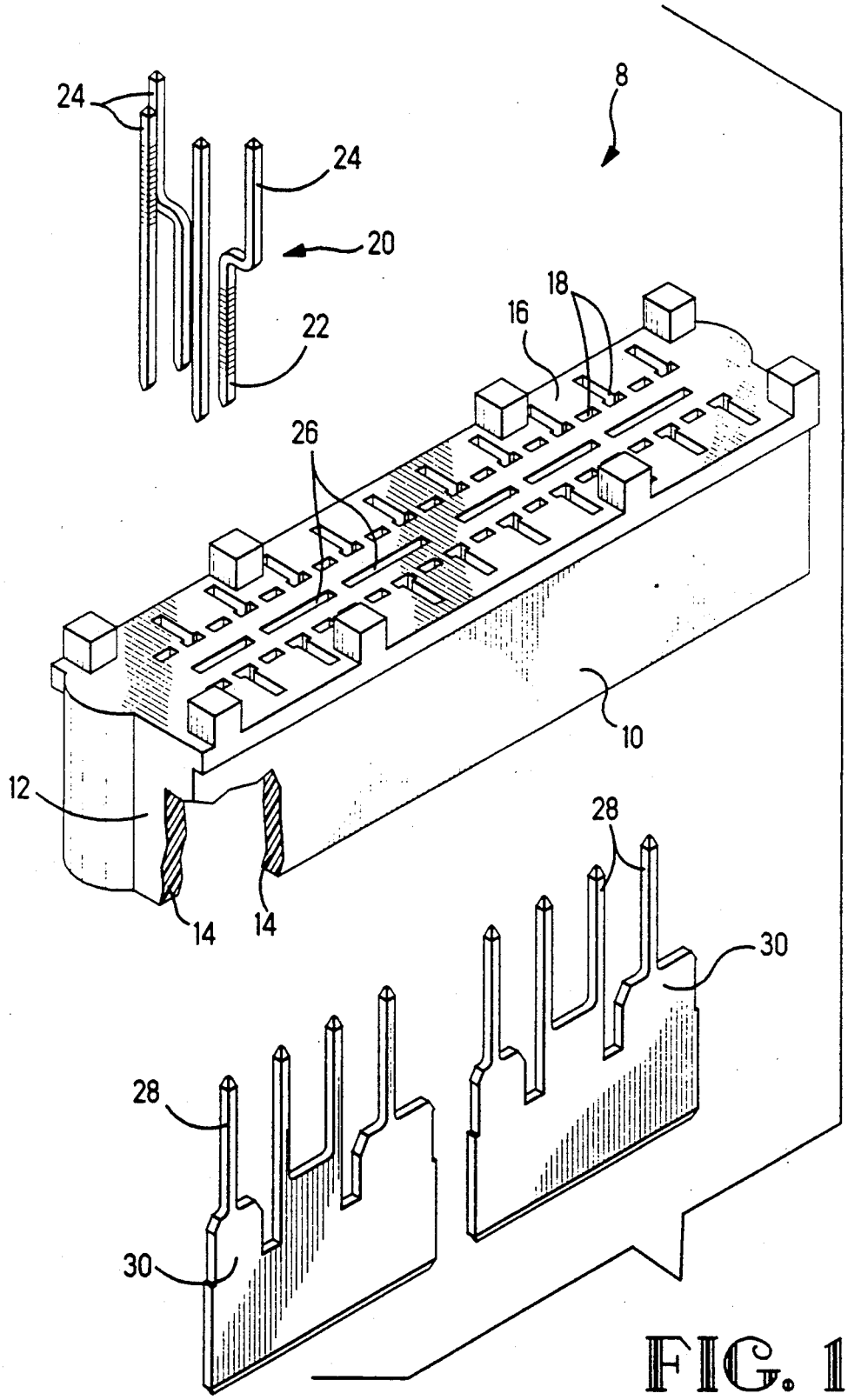
FIG. 1 is an isometric view showing a plug connector in exploded parts format.

There is shown in FIG. 1 a plug connector 8 composed of an insulating connector housing 10 having a main body portion 12, side shrouds 14, and a side 16 for mounting against a surface of a printed circuit board. Two parallel rows of cavities 18 are formed along the length of the housing 10 for receiving male signal contacts 20 each of which has a contacting portion 22 for electrically contacting a receptacle contact and a post or solder tail portion 24 extending from the side 16 for inserting into a plated through hole in the printed circuit board. The housing 10 includes several openings 26 for receiving posts or solder tails 28 of a ground bus bar 30, the tails also extending from the side 16 for inserting into holes in the printed circuit board. The plug connector 8 is arranged to mate with a receptacle connector 40, shown in FIG. 2, having an insulating connector housing 42. A plurality of signal receptacle contacts 44 are arranged in two parallel rows of cavities 46 which correspond to and are in alignment with the cavities 18 of the plug connector 8. The receptacle connector 40 includes a receptacle bus bar 48 composed of one or more sections each having a plurality of solder tails 54. The sections of bus bar 48 are arranged in slots 56 disposed in the connector housing 42 so that the solder tails 54 extend out of one side 60 of the housing for insertion into plated through holes 58 disposed in a printed circuit board 59. Additionally, each of the signal receptacle contacts 44 includes a post or solder tail 45 that extends out of the side 60 for insertion into holes 62 and 64 disposed in the printed circuit board 59. There is shown in FIG. 3, in cross section, the connectors 8 and 40 in mating engagement with the solder tails 24,28,45, and 54 inserted into position within their respective plated through holes in the two printed circuit boards. The solder tails are soldered in place within the holes, however, the solder has been omitted from FIG. 3 for clarity. For a more detailed description of the plug and receptacle connectors 8 and 40, please refer to the '500 patent referenced above.

Figure 3:
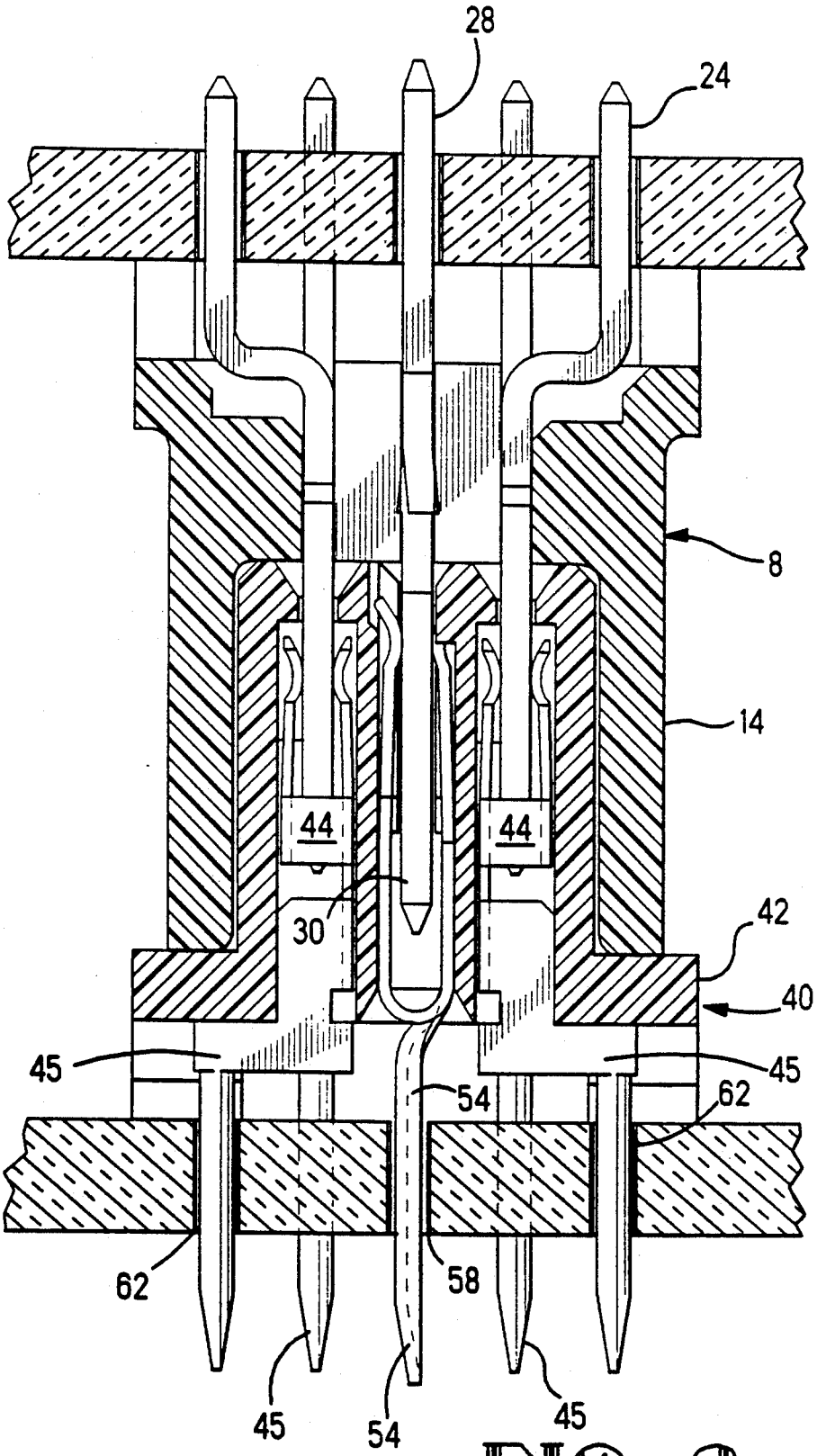
FIG. 3 is a cross-sectional view of the connectors of FIGS. 1 and 2 shown assembled.
Figure 4:
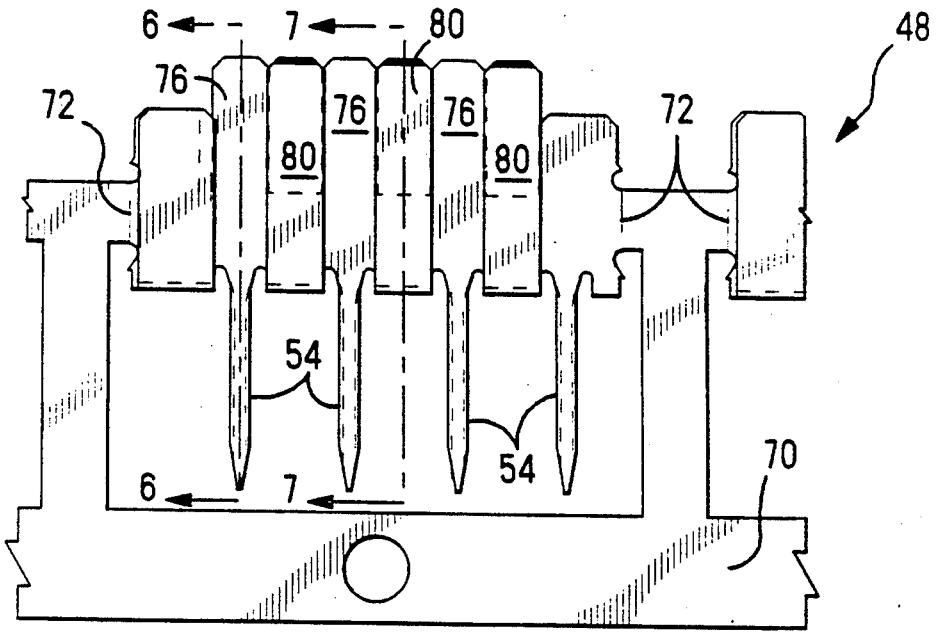
FIG. 4 is a front view of a portion of the ground bus shown in FIGS. 2 and 3.
Figure 5:
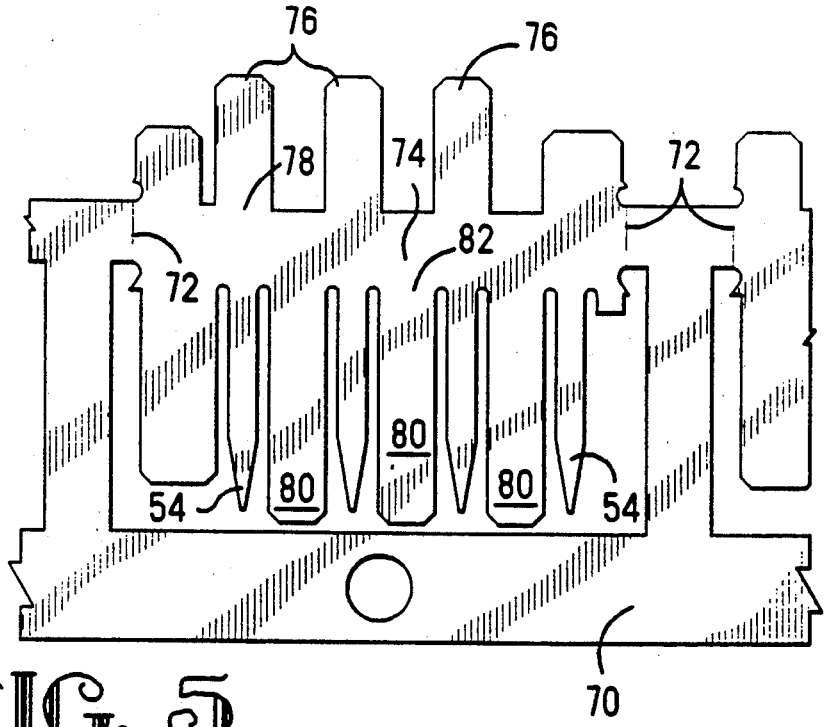
FIG. 5 is a flat pattern view of the ground bus prior to forming.
Figure 7:
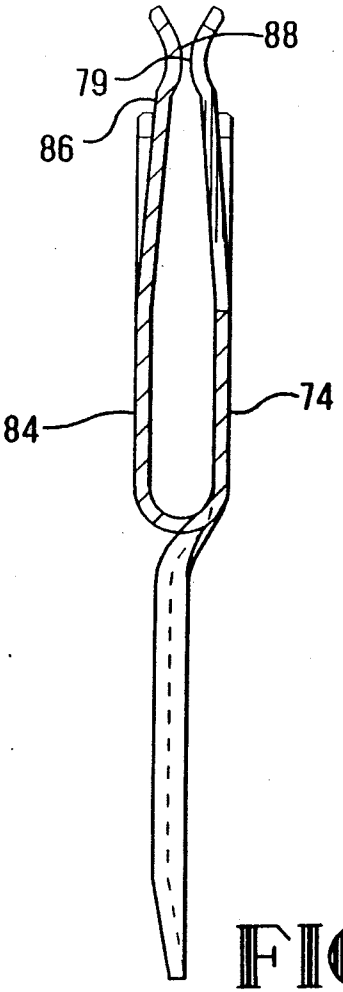
Figure 8:
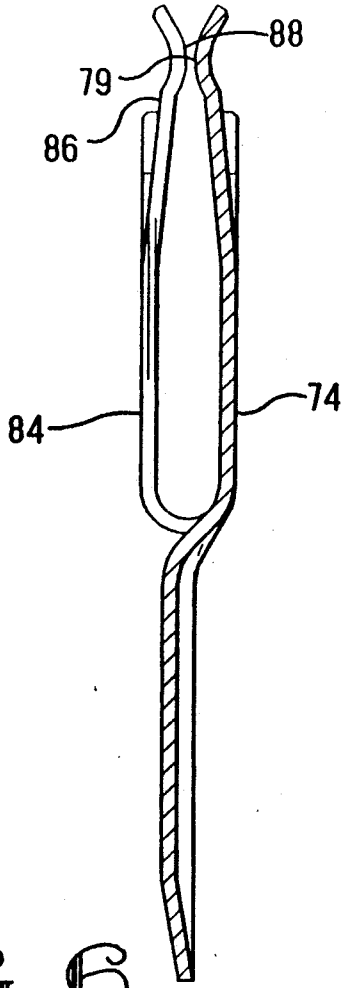

There is shown in FIG. 4 the receptacle bus bar 48 including a carrier strip 70 which is removed just prior to assembly into the housing 42 by blanking along the phantom lines 72. A flat pattern of the bus bar as initially blanked and prior to forming is shown in FIG. 5 including a root section 74 having a substantially rectangular cross section. There are three first beams 76 extending from one side 78 of the root section 74 and three members 80 extending from the opposite side 82 of the root section. Note that the three beams 76 and the three members 80 are spaced so that they are staggered. The reason for this will be set forth below. Four solder tails 54 extend from the side 82 in the same direction as and adjacent the members 80 as shown. After the initial blanking operation, the members 80 are bent outwardly along an arcuate path for substantially 180 degrees, thereby forming a radius 83, so that the members 80 each have a shank portion 84 that is substantially parallel to the root section 74, as best seen in FIGS. 4 and 7. A second beam 86 extends from and in generally the same direction as the shank 84 and terminates in a contact 88 for each member 80. The first beams 76 each terminate in a contact 79 as shown in FIGS. 6 and 7. While the first and second beams 76 and 86 are not directly opposed but rather are staggered, as best seen, in FIG. 4, they converge slightly toward an imaginary plane between the two rows of beams. This convergence is chosen so that when the male bus bar 30 is mated to the receptacle bus bar 48, as best seen in FIG. 3, the normal force at the point of contact with the contacts 79 and 88 is within the desired range.

In the present example, the bus bar 48 is made of phosphorous bronze having a stock thickness of 0.006 inch. The root section 74 is about 0.100 inch long and the first beam 76 also is about 0.100 inch long, as viewed in FIG. 7. The shank portion 84 is about 0.115 inch long and the second beam 86 is about 0.085 inch long. The reason that the first beam 76 is long than the second beam 86 is because the first beam is more stiff due to the root section 74 being adjacent the base of the first beam while the base of the second beam is adjacent the shank which has substantially the same width as the beam. This extra length is chosen to compensate for the extra stiffness and thereby substantially equalize the displacement and force of the two contacts 79 and 88 as the male bus 30 is inserted therebetween. The contact force in the present example is about 80 grams. The root section 74 and shank portion 84 are spaced apart a distance that assures a line to line contact or a slight interference fit with the walls of the slots 56. Such line to line contact has the advantage of maintaining the ground bus receptacle 48 in proper position prior to mating with the ground bus 30. An important additional advantage is that the characteristic impedance of the connector is more easily controlled because, as set forth in the above mentioned '500 patent, the signal contacts 44 and the ground bus 48 are urged into contact with a common dielectric wall 100,102 as best seen in FIG. 3. A U-shaped channel 104 is formed in the solder tails 54 along their longitudinal length, as shown in FIG. 6. The channel 104, which may be V-shaped or some other suitable shape, stiffens the solder tails to help maintain their mutual alignment prior to insertion into the holes 58 in the substrate 59.

Figure 2:
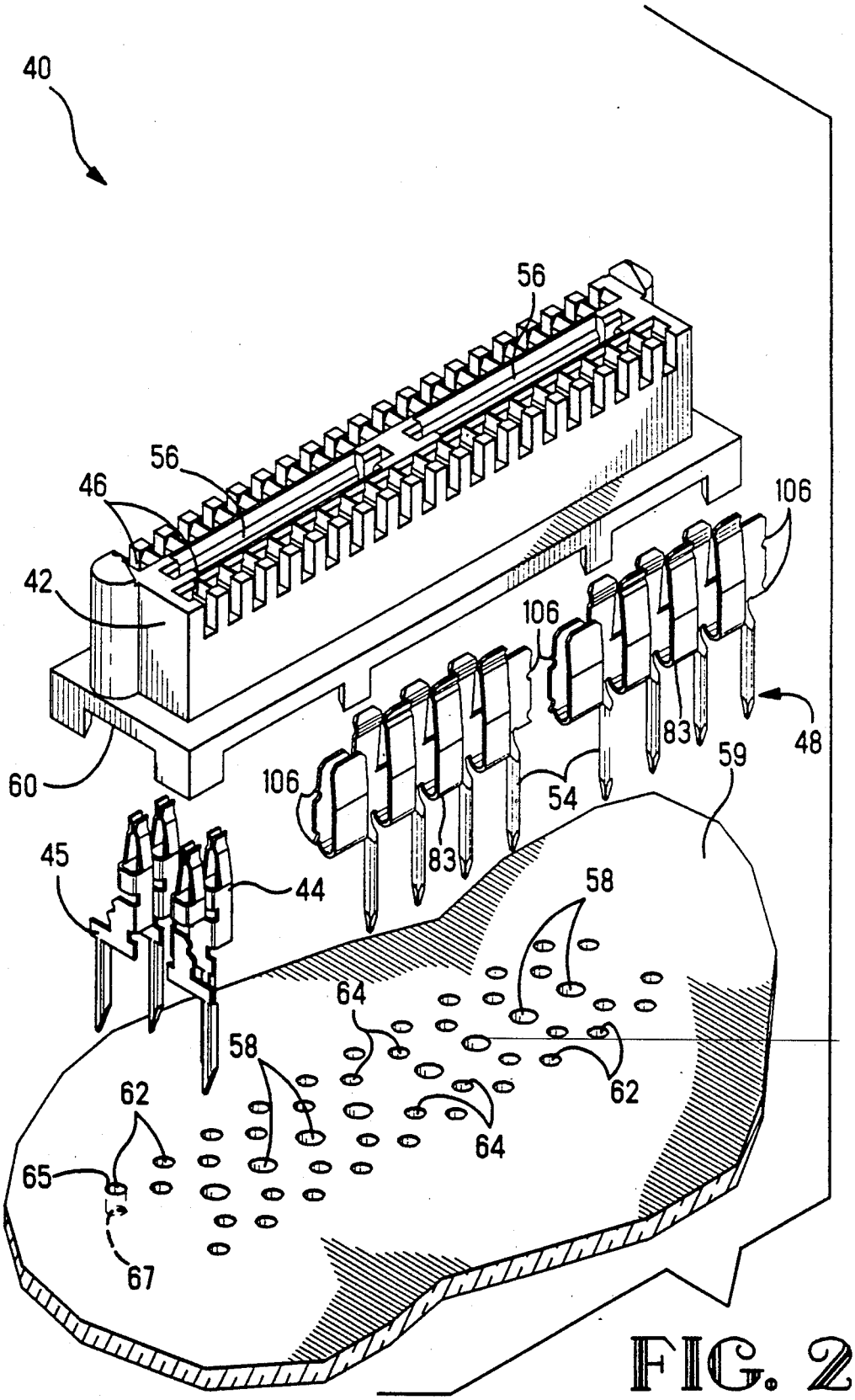
FIG. 2 is a view similar to that of FIG. 1 showing a receptacle connector having a ground bus in accordance with the teachings of the present invention.

There are four barbs 106, as seen in FIGS. 2, 4, and 5, which interfere with the end walls of the slots 56 to retain the receptacle ground bus sections 48 within the housing 42 in the usual manner. As set forth above, the beams 76 and 86 are staggered so that each space between adjacent first beams 76 is opposed by a second beam 86 and each space between adjacent second beams 86 is opposed by a first beam 76. This is done to facilitate plating of the first and second contacts 79 and 88. As will be appreciated by those skilled in the art, it is difficult to adequately plate opposing contacts that are very close together. However, assuming this were of no concern, the positions of each member 80 and an adjacent solder tail 54 may be switched yielding opposed beams 76 and 86 and consequently opposed contacts 79 and 88 without departing from the teachings of the present invention. Further, while the member 80, in the present example, is bent through an arcuate path forming the radius 83, the arcuate path need not follow a radius. It may simply be a pair of right angle bends or a V-shaped bend terminating in a shallow bend on each leg of the V, or some other suitable shape.

An important advantage of the one-piece ground bus of the present invention over the prior art two-piece ground bus is that the one-piece ground bus is more easily assembled and is automatically maintained in proper position within the slots in the connector housing prior to assembling and soldering to the printed circuit board. Additionally, the characteristic impedance of the connector is maintained while utilizing a less expensive one-piece ground bus structure.

I claim:

1. A controlled impedance electrical connector in which a plurality of signal contacts arranged in at least one row are positioned adjacent a ground bus, the signal contacts of said one row being separated from the ground bus by a first dielectric wall, said ground bus being of unitary construction and extending along a portion of the length of said one row and comprising:

(a) a bus root section being of approximately rectangular cross section;

(b) a plurality of first beams spaced apart and extending from one side of said root section, each terminating in a first contact;

(c) a plurality of members spaced apart and extending from an opposite side of said root section each member following an arcuate path for substantially 180 degrees and then extending substantially parallel to said root section thereby forming a shank and then extending further to form a second beam and terminating in a second contact; and (d) a plurality of leads extending from said opposite side for making electrical contact with circuits on a substrate.

2. The connector according to claim 1 wherein said bus root section is substantially flat and each shank of said plurality of members is substantially parallel to said bus root section.

3. The connector according to claim 2 wherein said first and second beams mutually converge.

4. The connector according to claim 3 wherein the length of said first beam is greater than the length of said second beam.

5. The connector according to claim 1 wherein adjacent ones of said first beams include a space therebetween and each said space is opposed by a second beam so that said first and second beams are mutually staggered.

6. The connector according to claim 1 including an insulating housing containing said at least one row of signal contacts and at least one slot arranged substantially parallel to said row, wherein said ground bus is disposed in said slot and said first dielectric wall is a wall of said slot.

7. The connector according to claim 6 wherein said shank and said root section are spaced apart a distance that is substantially equal to or greater than the width of said slot thereby establishing a line to line fit or slight interference fit therewith.

8. The connector according to claim 6 including a second row of signal contacts disposed in said housing parallel to said first row on a side of said ground bus opposite that of said first row, said second row of contacts being separated from said ground bus by a second dielectric wall which is another wall of said slot opposite said first dielectric wall.

9. The connector according to claim 1 wherein adjacent said members are spaced apart so that a said lead extends from said root section between said adjacent members.

* * * * *